US009103078B2

(12) United States Patent
Lutz

(10) Patent No.: US 9,103,078 B2
(45) Date of Patent: Aug. 11, 2015

(54) SCREED PLATE

(75) Inventor: David Lutz, Loomis, CA (US)

(73) Assignee: Kenco Engineering, Inc., Roseville, CA (US)

( * ) Notice: Subject to any disclaimer, the term of this patent is extended or adjusted under 35 U.S.C. 154(b) by 696 days.

(21) Appl. No.: 12/954,407

(22) Filed: Nov. 24, 2010

(65) Prior Publication Data

US 2011/0123269 A1 May 26, 2011

Related U.S. Application Data

(60) Provisional application No. 61/264,143, filed on Nov. 24, 2009.

(51) Int. Cl.
*E01C 19/42* (2006.01)

(52) U.S. Cl.
CPC ..... *E01C 19/42* (2013.01)

(58) Field of Classification Search
USPC ..... 404/114, 118, 120
See application file for complete search history.

(56) References Cited

U.S. PATENT DOCUMENTS

| | | | | | |
|---|---|---|---|---|---|
| 3,004,785 | A | * | 10/1961 | Wolf | 52/633 |
| 4,818,140 | A | | 4/1989 | Carlson | |
| 4,865,487 | A | * | 9/1989 | Lutz | 404/118 |
| 5,052,853 | A | * | 10/1991 | Trowbridge | 404/92 |
| 5,174,101 | A | * | 12/1992 | Rabitsch | 56/17.4 |
| 5,366,320 | A | * | 11/1994 | Hanlon et al. | 404/118 |
| 5,397,199 | A | * | 3/1995 | Frampton et al. | 404/118 |
| 6,543,962 | B2 | | 4/2003 | Wells | |
| 7,284,929 | B2 | | 10/2007 | Schwenninger | |
| 2002/0061227 | A1 | * | 5/2002 | Rahn et al. | 404/118 |
| 2007/0258769 | A1 | | 11/2007 | Eppes | |
| 2009/0092444 | A1 | * | 4/2009 | Schoen | 404/118 |
| 2010/0308548 | A1 | * | 12/2010 | Meers | 280/11.19 |

* cited by examiner

*Primary Examiner* — Abigail A Risic
(74) *Attorney, Agent, or Firm* — Temmerman Law Office; Matthew J. Temmerman

(57) ABSTRACT

An improved screed plate having a top surface, a bottom surface, a curved leading edge and a trailing edge adapted for attaching to a screed of a paving machine is disclosed. The improved screed plate comprises a tapered groove extended from the curved leading edge towards the trailing edge along the top surface and terminated in a groove end. The tapered groove is arranged deepest at the curved leading edge and shallowest toward the trailing edge so as to provide flexibility to the screed plate while not reducing screed plate lifetime due to increased wear and tear. The increased screed plate flexibility facilitates crowning and other adjustments that require bending of the screed plate, and allow harder steels to be used than are used in conventional screed plates.

20 Claims, 9 Drawing Sheets

SCREED PLATE

RELATED APPLICATIONS

This application is related to and claims priority from provisional patent application Ser. No. 61/264,143, filed Nov. 24, 2009.

BACKGROUND OF THE INVENTION

1. Technical Field of the Invention

The present invention relates in general to paving machines for paving a path of limited width. More specifically, the present invention relates to an improved screed plate adapted for attaching to a screed of a paving machine.

2. Description of the Related Art

Most asphalt pavers are large and intricate machines comprising a tractor unit and a screed unit. The screed unit operates based on the principle of the self-leveling and floating screed. These devices are well known and are used for leveling and consolidating paving materials such as asphalt, concrete and the like. The screed unit includes a replaceable screed plate, constructed of suitable steel, to spread paving material (asphalt, aggregate, concrete, petroleum bitumen and the like) to a proper thickness, and to create a smooth surface after the paving material is applied to the roadway during road construction. The screed also provides the initial compaction of paving materials. The screed plate further must have the capacity to conform to the desired profile of the pavement (e.g. a crowned road). These non-level profiles are required to facilitate water runoff, especially during rainstorms. While a simple crowned profile may suffice in many paving scenarios, urban paving poses additional complications and problems as intersections generally require changes in the simple crowned profile so as to allow for multi-directional rainfall runoff. In order to meet these requirements, a screed plate must bend and deflect to a shape that meets the applicable specifications.

FIG. 1 is a perspective view of a prior art paving machine 10 with a screed unit 12 attached thereto. The conventional paver operates based on the principle of the self-leveling, floating screed. Here, the screed unit 12 is a free-floating unit that strikes off, compacts, and flattens raw material into a mat surface as the screed 12 is pulled forward by the paving machine 10. The screed unit 12 is attached to the paving machine 10 at only two points, each called a pull point or tow point, one on each side of the paver. The screed unit 12 has two long pull arms to make this connection to the pull point and in operation, pivot arms 14 are disposed between the pull arms and the pull points and provide no vertical support for the screed unit 12. As the paving machine 10 pulls the screed unit 12 into the freshly laid material, it floats on the mix of paving material, moving up or down and naturally seeking the path where the forces acting on the screed unit 12 are in equilibrium and the path of its flat bottom is approximately parallel to the direction of operation of the paver.

FIG. 2 is a perspective view of another prior art screed assembly of the paving machine 20. The screed assembly 20 includes a vibrator 21, which causes the paving material to feed more uniformly under the screed assembly 20 and provide some initial compaction to the freshly laid material. The screed assembly 20 further includes a screed heater 23, which prevents the paving material mixtures from sticking to the screed plate 24. The optional attachments such as cutoff shoes/screed extensions 25 may be attached to the screed assembly 20 to vary the paver width.

Various screed plates have been devised for attaching to the screed unit of a paving machine. U.S. Pat. No. 5,366,320 issued to Hanlon on Nov. 22, 1994 provides an improved screed for leveling abrasive paving material on a road surface. The improved screed is highly abrasion-resistant and loses much less heat during shutdown periods than steel screeds because it is formed of a composite that includes a chromium-carbide alloy. The composite is formed of a relatively soft metal that is completely fused to the chromium-carbide alloy. The part of the composite that comes in direct contact with the abrasive paving material is made of highly abrasion-resistant chromium-carbide alloy, which has a Brinell hardness in the range 550 to 600 and a low coefficient of friction. Additionally, the low thermal conductivity of the chromium-carbide alloy permits it to retain more heat during shutdown. The relatively soft metal portion of the composite, which may be low-carbon steel, provides an easy and reliable surface for affixing standard attachment components, such as bolts, to the improved screed, providing an effective means for mounting the improved screed to the paving machine. A curved leading edge of the screed prevents the paving material from welling up on to the relatively soft upper surface of the improved screed. The curved leading edge is formed of the same composite as the rest of the screed. A shortcoming of the improved screed is that although the metal component forming the bottom surface of the screed is extremely hard and durable, in the Brinell range of 550-600, the top surface of the screed is made of softer metal, in the Brinell range of 150-200. Thus, the top surface of the screed is easily subject to maximum wear and tear from the harsh mechanical forces involved.

U.S. Pat Application. No. 20060045624 to Nelson and published on Mar. 2, 2006 provides a screed heating arrangement for a screed assembly that is towed behind a paving machine. The screed heating arrangement includes at least one electric heater bonded to an upper surface of a screed plate. The screed is made up of hardened steel that is actually stronger than the frame assembly that attaches screed to the paving machine. This can lead to warping of the frame assembly.

Other conventional paving machines include a screed plate having a bottom surface made of softer steel. There, the bottom surface that is dragged along the mat will lose smoothness, and rapid and excessive wear will ultimately lead to early replacement of the screed plate. Conventional screed plates typically wear out about 4 to 6 inches forward from the trailing edge. This is due to the standard angle at which the screed contacts the paving material during use, which lifts the front edge of the screed, placing more pressure and wear and tear on the trailing edge.

Typically the conventional soft screed plates cannot be used in the entire work season, since the soft screed plate can bend and conform to assist with crowning. Even though the conventional harder screed plate may last for the entire season, it is typically too hard to bend and conform as described above.

Hence, it can be seen, that there is a need for an improved screed plate with the flexibility of softer steel and durability of harder steel. Further, the improved screed plate is made of high strength steel that will not warp the screed frame assembly as the screed plate is bent to effect proper crowning. Moreover, the improved screed plate would include a tapered groove possessing sufficient depth at a curved leading edge of the screed plate so as to allow improvements in crowning performance by permitting and proper deflection of the hardened steel.

It is thus a first objective of the present invention to provide an improved screed plate with a flexibility of softer steel and durability of harder steel.

It is a second objective of the present invention to provide an improved screed plate of high strength steel that will not warp the screed frame assembly as the screed plate is flexed and inverted to effect proper crowning.

It is a third objective of the present invention to provide an improved screed plate with a tapered groove that possess sufficient depth at a curved leading edge of the screed plate to allow proper deflection of the harder steel.

It is a fourth objective of the present invention to provide an improved screed plate with a tapered groove that changes in depth approximately 0.187 inches over the course of approximately 15 inches of screed width or about 0.0125 inches per inch.

It is a fifth objective of the present invention to provide an improved screed plate with a tapered groove that allows improvements in crowning and deflection of the screed plate to be accomplished even when a relatively hard inflexible material is used for screed plate, such as 500 and 600 Brinell hardness number (BHN) steel.

These and other advantages and features of the present invention are described with specificity so as to make the present invention understandable to one of ordinary skill in the art.

SUMMARY OF THE INVENTION

To minimize the limitations found in the prior art, and to minimize other limitations that will be apparent upon reading of the specification, the present invention provides an improved screed plate having a top surface, a bottom surface, a curved leading edge and a trailing edge, the improved screed plate adapted for attaching to a screed of a paving machine. The improved screed plate comprises a tapered groove extended from the curved leading edge towards the trailing edge along the top surface and terminated in a groove end. The tapered groove is arranged such that the groove is deepest at the curved leading edge and shallowest toward the trailing edge so as to provide flexibility to the screed plate thereby facilitating crowning and other adjustments that require the screed plate to bend.

In an alternative of the present invention, the tapered groove on the top surface is deeper at the curved leading edge and tapers to zero at the trailing edge. The tapered groove is shallower toward the trailing edge; hence the material comprising the improved screed plate at the trailing edge remains thicker, providing more material to be worn through before the screed plate requires replacement. The tapered groove is deeper at the curved leading edge; hence the material comprising the improved screed plate at curved leading edge remains thinner. This is acceptable because the curved leading edge is subjected to less wear than the trailing edge. Thus, the screed plate may flex due to the thinner steel at the location of the tapered groove, but not be subject to a reduced useful lifetime due to the wear that would be expected if the deep groove continued to the trailing edge of the screed plate. In a preferred embodiment, the tapered groove is one-eighth inch deep at the leading edge in order to match the one-eighth inch kerf of the front of the screed plate. The slope of the tapered groove may be modified to suit various screed widths from a variety of manufacturers.

BRIEF DESCRIPTION OF THE DRAWINGS

In order to enhance their clarity and improve understanding of various elements and embodiments of the invention, these elements in the figures have not necessarily been drawn to scale. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
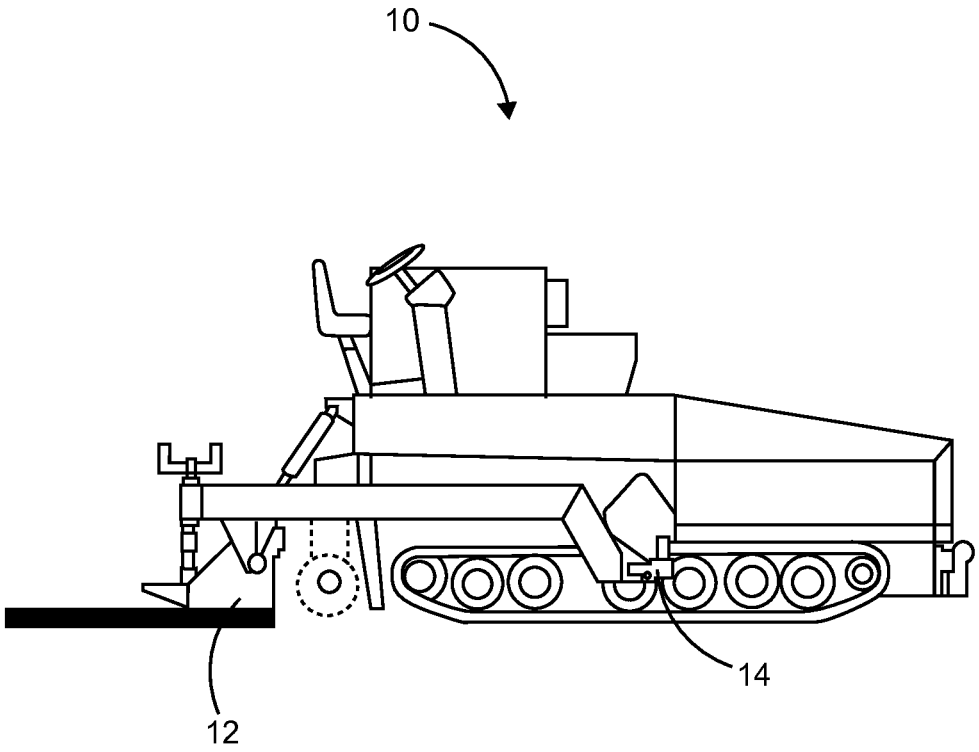
PRIOR ART FIG. 1
FIG. 1 is a perspective view of a prior art paving machine with a screed unit attached thereto.
Figure 2:
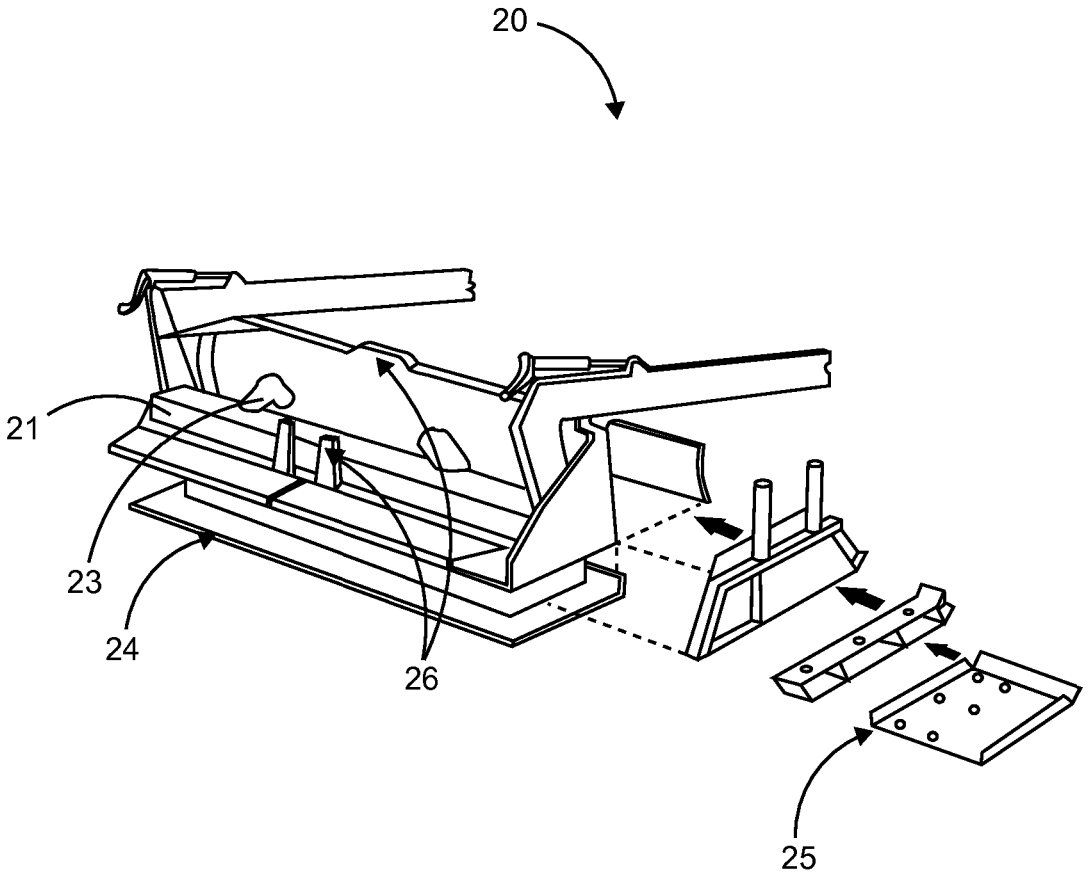
PRIOR ART FIG. 2
FIG. 2 is a perspective view of another prior art screed assembly of the paving machine.
Figure 3:
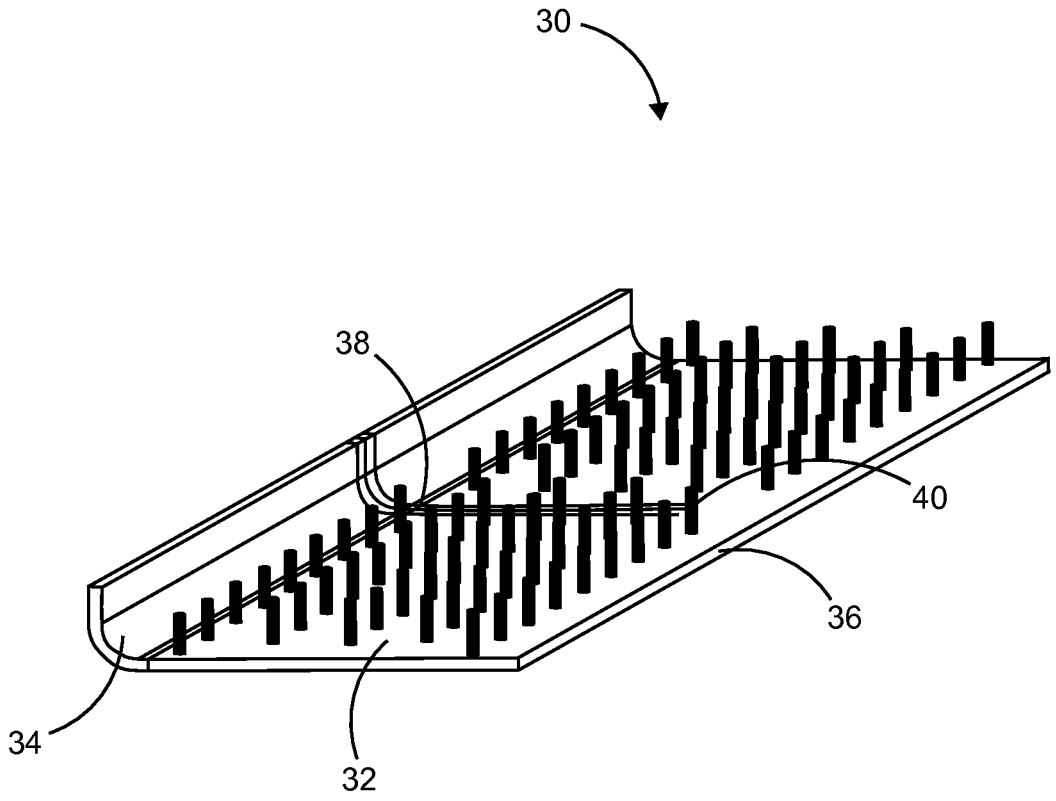
FIG. 3 is a perspective view of an improved screed plate according to a preferred embodiment of the present invention.

FIG. 3 is a perspective view of an improved main screed plate 30 according to a preferred embodiment of a present invention. The improved main screed plate 30 has a top surface 32, a bottom surface (not shown), a curved leading edge 34 and a trailing edge 36, and is adapted for attaching to a screed of a paving machine. The improved main screed plate 30 comprises a tapered groove 38 extended from the curved leading edge 34 towards the trailing edge 36 along the top surface 32 and terminated in a groove end 40. For ease of understanding, the leading edge 34, the tapered groove 38, and groove end 40 are all shown in cross sectional view in FIG. 6, which will be described in more detail below. Turning back to FIG. 3, the tapered groove 38 is arranged such that the groove 38 is deepest at the curved leading edge 34 and shallowest toward the trailing edge 36 so as to provide flexibility to the main screed plate 30 thereby facilitating crowning and other adjustments that require the screed plate 30 flex or invert to allow for crowning and shaping. The screeds are often flexed under extreme tensile loads during use to achieve desired crowning which is bending of the screed in a direction so that the center is higher than the ends.

The tapered groove 38 allows the bending of the screed plate 30 on each side away from the tapered grooves 38, which cause flexing of the plate 30. Thus, the grooves 38 control the crowning operation so that the depth of material deposited stays within predetermined limits. The grooves 38 provide equal and simultaneous crowning or inverting of the leading and trailing edges 34, 36. Inverting of the screed causes the bending of the screed so that the ends are higher than the center. Each side of the screed plate 30 is actually bent upwards forming a V shape with respect to the groove 38 on top when the screed is inverted. Hence, the groove 38 on top of the screed plate 30 allows the metal on each side of the groove 38 to move toward each other.

Figure 4:
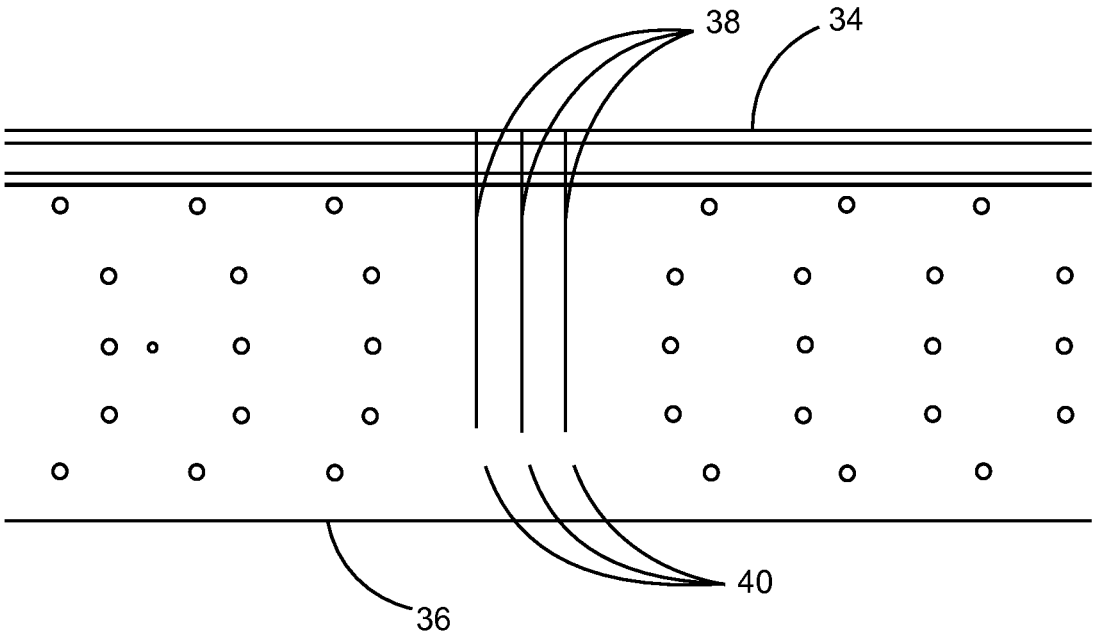
FIG. 4 is a blown up view of just the middle portion of the exemplary screed.
Figure 5:
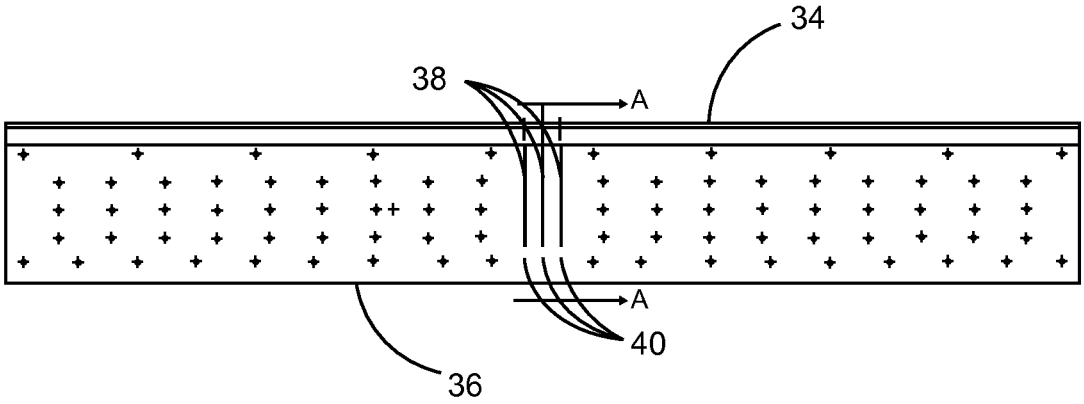
FIG. 5 is a is an exemplary screed shown in its entirety, with a section A-A marked.

Referring to FIGS. 4 and 5, different views of the improved main screed plate 30 are illustrated. FIG. 5 is an exemplary screed shown in its entirety while FIG. 4 is a blown up view of just the middle portion of the exemplary screed. In both FIGS. 4 and 5, the curved leading edge 34 of the main screed plate 30 is the edge that faces forward during normal operation. The curved leading edge 34 is generally lifted off the mat according to the angle at which the screed plate 30 contacts the paving material. Because it is generally lifted off the mat, it is generally subjected to less wear. The trailing edge 36 is that edge facing away from the forward motion of the screed plate 30, and is the edge that suffers from the most wear and tear as the improved main screed plate 30 is dragged along the mat of the paving material.

Figure 6:
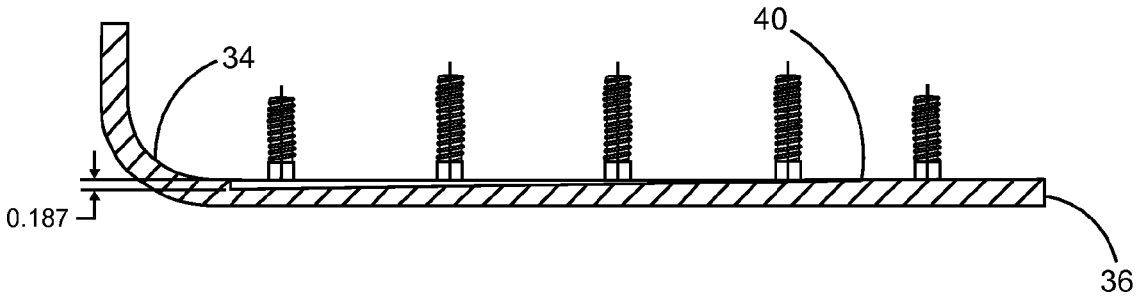
FIG. 6 is a cross-sectional view of the invention, taken generally along lines A-A of FIG. 5, illustrating a tapered groove of the preferred embodiment.

FIG. 6 is a cross-sectional view of the invention, taken generally along lines A-A of FIG. 5, best illustrating the tapered groove 38 of the preferred embodiment. The tapered groove 38 on the top surface 32 is deeper at the curved leading edge 34 and tapering to zero at the trailing edge 36. The tapered groove 38 is increasingly shallower toward the trailing edge 36, hence the material at the trailing edge 36 remains thicker, and thus there is more material to be worn through before the main screed plate 30 requires replacement. The tapered groove 38 is deeper at the curved leading edge 34; hence the material at curved leading edge 34 is thinner. This is beneficial because the curved leading edge 34 is subjected to less wear. Moreover, the main screed plate 30 may flex due to the thinner steel at the location of the tapered groove 38, but not be subject to reduced lifetime due to increased wear that would be expected if the deep groove continued to the trailing edge 36 of the main screed plate 30.

The tapered groove 38 provides sufficient depth at the curved leading edge 34 of the main screed plate 30 to allow for proper deflection of the hardened steel. Further, the tapered groove 38 is at zero depth just prior to where the first failure would normally occur. The slope of the tapered groove 38 may be modified to suit various screed widths from a variety of manufacturers. In the preferred embodiment, the tapered groove 38 changes in depth approximately 0.187 inches over the course of approximately 15 inches of screed width, or about 0.0125 inches per inch.

The tapered groove 38 is wide enough to allow for full screed inversion. In a preferred embodiment the tapered groove 38 is one-eighth inch wide. In a less preferred embodiment the width may be between $1/16^{th}$ of an inch to $3/8^{th}$ of an inch wide. In all cases, however, the width of tapered groove is no more than 1% the screed length. Thus, if the screed length is 120 inches (for paving a 10' strip), the tapered groove 38 will be no more than 1.2 inches wide. Hence, the width of the tapered groove 38 in this embodiment is a function of screed length. The width represents the smaller distance, from front to back on the screed plate 30 and the length represents how wide a strip of pavement will be flattened. In the preferred embodiment the tapered groove 38 is 0.1 to 0.3 inches deep at the curved leading edge 34 and the tapered groove's depth 10% to 50% the thickness of the screed plate 30 deep at the curved leading edge 34. Further, in the preferred embodiment tapered grooves 38 taper to zero depth just prior to where the first failure would normally occur. This is generally at a point between 75% and 92%, the distance between the curved leading edge 34 and the trailing edge 36, as shown best in FIG. 9. Although the tapered grove preferably terminates at a tapered groove end, in other embodiments the groove may terminate in a notched or rounded end.

Figure 7:
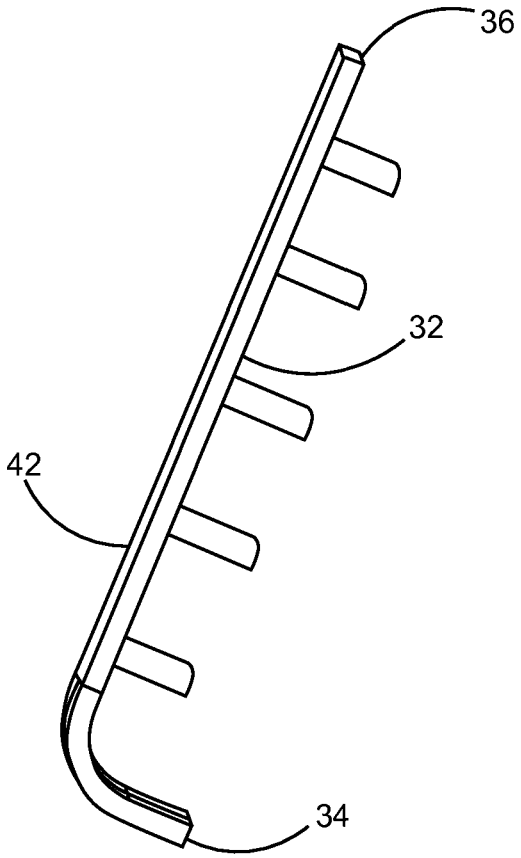
FIG. 7 is a side view of an improved screed plate according to the preferred embodiment of the present invention.

FIG. 7 is a side view of the improved screed plate 30 according to a preferred embodiment of a present invention. The present invention thus provides the optimum combination of very hard steel along with the flexibility, durability and workability of the improved screed. The tapered groove 38 allows improvements in that crowning and deflection of the main screed plate 30 may be accomplished even when a relatively hard, inflexible material is used for main screed plate 30, such as steel with a Brinell hardness number (BHN) of between 500 and 600. Although various BHNs have been described, in a preferred embodiment the BHN of the improved main screed plate 30 is between 460 and 544, and in a less preferred embodiment the BHN is 400 or higher.

Figure 8:
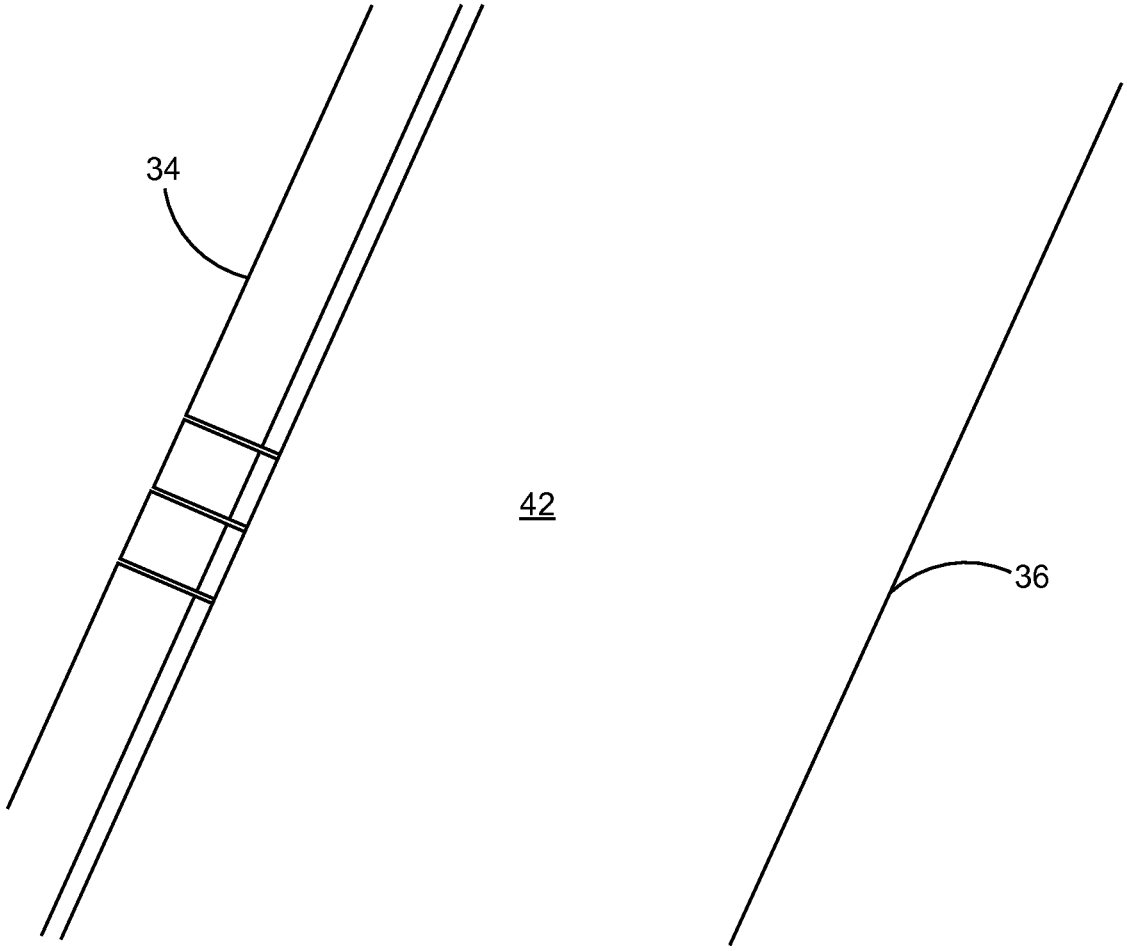
FIG. 8 is a perspective view of a portion of a bottom surface of the improved screed plate according to the preferred embodiment of the present invention.

FIG. 8 is a perspective view of a portion of the bottom surface 42 of the improved screed plate 30 according to the preferred embodiment of the present invention. Trailing edge 36 is depicted. The bottom surface 42 of the main screed plate 30 is adapted to engage the paving material being compacted and smoothed, while the top surface 32 of the screed plate 30 is arranged opposite the bottom surface 42. The mat of material smoothed by the present invention is generally asphalt, bioasphalt, aggregate, petroleum bitumen, cement, or concrete. The present invention smoothes the mat of material uniformly and to any required thickness, shape and width.

Figure 9:
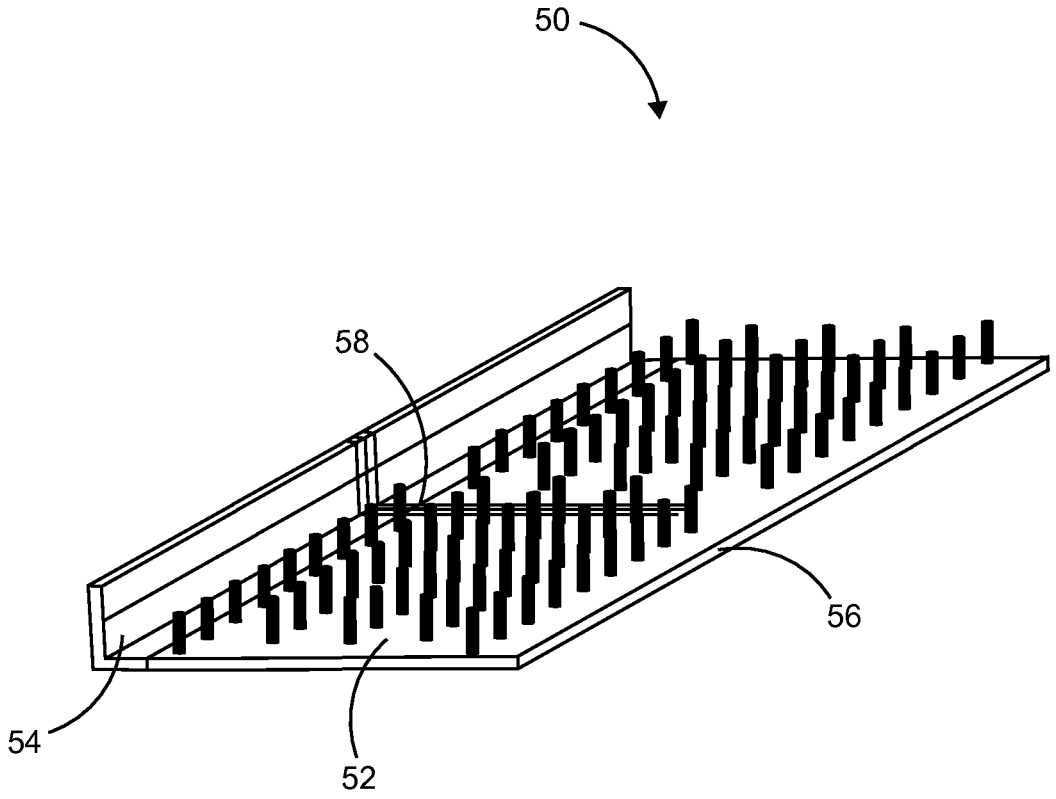
FIG. 9 is a perspective view of another embodiment of the present invention.

FIG. 9 is a perspective view of another embodiment of the present invention. An improved screed plate 50 includes a top surface 52, a bottom surface (not shown), a leading edge 54 and a trailing edge 56. The improved screed plate 50 adapted for attaching to a screed of a paving machine comprises at least one tapered groove 58 extending from proximate to the leading edge 54 towards the trailing edge 56. The bottom surface (not shown) is adapted to engage with material being compacted and smoothed. The tapered groove 58 is deepest proximate to the leading edge 54 and shallowest towards the trailing edge 56.

Although the invention has been shown and described with respect to certain embodiments, it is obvious that equivalent alterations and modifications will occur to others skilled in the art upon the reading and understanding of the specification. In particular, with regard to the various functions performed by the above-described components, the terms (including any reference to a "means") used to describe such components are intended to correspond, unless otherwise indicated, to any component which performs the specified function of the described component (e.g., that is functionally equivalent) even though not structurally equivalent to the disclosed component which performs the functions in the herein exemplary embodiments of the invention. In addition, while a particular feature of the invention may have been disclosed with respect to only one embodiment, such feature may be combined with one or more other features of other embodiments as may be desired or advantageous for any given or particular application.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

I claim:

1. An improved screed plate having a top surface, a bottom surface, a thickness, a length, a curved leading edge and a trailing edge, the improved screed plate adapted for attaching to a screed of a paving machine, the improvement comprising:

at least one tapered groove extending from the curved leading edge towards the trailing edge along the top surface and terminating in a groove end at between 75% and 92% the distance between the curved leading edge and the trailing edge;

wherein the bottom surface is adapted to engage with the material being compacted and smoothed; and whereby the tapered groove is arranged deepest at the curved leading edge and shallowest toward the trailing edge so as to provide flexibility to the screed plate.

2. The improved screed plate of claim 1 wherein the groove end is a tapered groove end.

3. The improved screed plate of claim 1 wherein the screed plate comprises steel in the Brinell hardness range of 460-544.

4. The improved screed plate of claim 1 wherein the screed plate is overlaid with chromium carbide.

5. The improved screed plate of claim 1 wherein said tapered groove is 0.1 to 0.3 inches deep at said curved leading edge.

6. The improved screed plate of claim 5 wherein the groove end is a tapered groove end.

7. The improved screed plate of claim 1 wherein said tapered groove has a width no more than 1% of screed length.

8. The improved screed plate of claim 7 wherein the groove end is a tapered groove end.

9. The improved screed plate of claim 1 wherein said tapered groove depth is 10%-50% the thickness of said screed plate deep at said curved leading edge.

10. The improved screed plate of claim 9 wherein the groove end is a tapered groove end.

11. An improved screed plate having a top surface, a bottom surface, a leading edge and a trailing edge, the improved screed plate adapted for attaching to a screed of a paving machine, the improved screed plate comprising:

at least one tapered groove extending from proximate to said leading edge towards said trailing edge;

wherein the bottom surface is adapted to engage with material being compacted and smoothed; and wherein said at least one tapered groove is deepest proximate to said leading edge and shallowest proximate said trailing edge.

12. The improved screed plate of claim 11 wherein the screed plate comprises steel in the Brinell hardness range of 460-544.

13. The improved screed plate of claim 11 wherein the screed plate is overlaid with chromium carbide.

14. The improved screed plate of claim 11 wherein said tapered groove is 0.1 to 0.3 inches deep at said curved leading edge and terminates in a tapered groove end at between 75% and 92% the distance between the leading edge and the trailing edge.

15. The improved screed plate of claim 11 wherein said tapered groove has a width no more than 1% of screed length.

16. The improved screed plate of claim 15 wherein said tapered groove terminates in a tapered groove end at between 75% and 92% the distance between the leading edge and the trailing edge.

17. The improved screed plate of claim 11 wherein said tapered groove depth is 10%-50% the thickness of said screed plate deep at said leading edge.

18. The improved screed plate of claim 17 wherein said tapered groove terminates in a tapered groove end at between 75% and 92% the distance between the leading edge and the trailing edge.

19. An improved screed plate having a top surface, a bottom surface, a leading edge and a trailing edge, the improved screed plate adapted for attaching to a screed of a paving machine, the improved screed plate comprising:

at least one region on the top surface from which material has been removed so as to allow the screed plate to flex; and wherein said at least one region further comprises a tapered groove extending from proximate to said leading edge towards said trailing edge, said tapered groove being deepest proximate to said leading edge and shallowest towards said trailing edge.

20. The improved screed plate according to claim 19, wherein the tapered groove terminates in a tapered groove end at between 75% and 92% the distance between the leading edge and the trailing edge.

* * * * *